US006460363B1

(12) United States Patent
Moretti et al.

(10) Patent No.: US 6,460,363 B1
(45) Date of Patent: Oct. 8, 2002

(54) SPLIT HOUSING FOR OUTDOOR HEAT EXCHANGER

(75) Inventors: Stephen L. Moretti, Auburn, NY (US); David F. Kwasigroch, Syracuse, NY (US); Peter R. Bushnell, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/859,197

(22) Filed: May 16, 2001

(51) Int. Cl.[7] ..... F25D 23/12; F25B 47/00

(52) U.S. Cl. ..... 62/262; 62/279; 62/298; 62/303

(58) Field of Search ..... 62/262, 263, 298, 62/297, 303, 259.1, 272, 285, 150, 279

(56) References Cited

U.S. PATENT DOCUMENTS 4,102,148 A * 7/1978 Matthews ..... 62/77
6,067,812 A * 5/2000 Bushnell et al. ..... 62/280
6,182,460 B1 * 2/2001 Hernandez et al. ..... 62/262
6,276,156 B1 * 8/2001 da Silva et al. ..... 62/262
6,318,104 B1 * 11/2001 Moraes ..... 62/262
6,321,553 B1 * 11/2001 Bushnell et al. ..... 62/262

* cited by examiner

*Primary Examiner*—Denise L. Esquivel
*Assistant Examiner*—Marc Norman
(74) *Attorney, Agent, or Firm*—Wall Marjama & Bilinski LLP

(57) ABSTRACT

An air conditioning unit having an indoor section and an outdoor section separated by dividing wall. The outdoor heat exchanger and fan are enclosed within a housing that is split into a stationary lower wall section and a removable upper wall section which, when removed, provides ready access to the outdoor heat exchanger. A hole is placed in the bottom of the lower wall section in front of the fan so that condensate can be drawn into the unit by the fan and distributed over the heat exchanger surfaces. Vanes are placed on the inside wall of the housing to enhance the distribution of the condensate.

8 Claims, 4 Drawing Sheets

SPLIT HOUSING FOR OUTDOOR HEAT EXCHANGER

BACKGROUND OF THE INVENTION

This invention relates to a split outdoor fan housing for use in an air conditioning More specifically, this invention relates to a housing for use PTAC unit employing an outdoor fan having the capability of distributing condensate over the outdoor heat exchanger surfaces to improve the unit efficiency when the unit is operating in a cooling mode. Many package terminal air conditioners are used in hotels and motels to provide conditioned air to specific indoor areas such as rooms and the like. The unit is generally housed in a rectangular sleeve that is mounted in an outside wall of the area or room being serviced. The unit is separated into an indoor section and an outdoor section by a dividing wall. Each section includes a heat exchanger and a fan for moving air over the heat exchanger. When operating in a cooling mode, the outdoor heat exchanger acts as a condenser for reducing refrigerant vapors leaving the system compressor to a liquid state. To improve the efficiency of the outdoor heat exchanger, the outdoor section is sometimes provided with a slinger type fan that is arranged to distribute condensate provided by the indoor heat exchanger to aid in the condensing process and thus improve the overall efficiency of the unit. A housing is placed about the outdoor heat exchanger and fan to contain the condensate and to help in distributing outside air and condensate over the heat exchanger. A housing of this type is disclosed in U.S. Pat. No. 6,067,812.

The outdoor heat exchanger, because it is exposed to outdoor elements, collects dirt and other air borne contaminants which lodge in the exchanger surfaces, thereby reducing the unit performance. These surfaces must therefor be cleaned periodcally. It has heretofor been rather difficult to gain to these surfaces involving the removal of a large number of unit parts. As a consequence, the unit the down time during cleaning has been relatively long and the cost of maintaining this type of unit relatively high.

BRIEF SUMMARY OF THE INVENTION

It is an object of the present invention to improve air conditioners and, in particular packaged terminal air conditioners.

It is a further object of the present invention to facilitate cleaning of the outdoor heat exchanger of a packaged terminal air conditioner.

It is a still further object of the present invention to minimize the amount of time required to clean the outdoor heat exchanger of a packaged terminal air conditioner.

Another object of the present invention is to provide easy access to the outdoor heat exchanger of an air conditioner.

Yet another object of the present invention is to improve the distribution of condensate over the surfaces of the outdoor heat exchanger of a PTAC unit.

These and other objects of the present invention are attained in a packaged terminal air conditioner having an indoor section and an outdoor section, both of which contain a heat exchanger and a fan for moving air over the heat exchanger. A dividing wall is used to separate the indoor section from the outdoor section of the unit. A two piece housing is mounted in the outdoor section of the unit that encloses the area between the outdoor fan and the outdoor heat exchanger. The housing has a front wall with an opening that surrounds the outdoor fan through which air is drawn into the housing and passed over the heat exchanger surfaces. The housing includes a stationary lower wall section and a removable upper wall section that is secured to the lower wall section by any suitable type fastener. A hole is provided in the bottom of the lower wall section through which condensate is drawn by the outdoor fan into the housing and distributed over the outdoor heat exchanger. Vanes are placed upon the inner wall surfaces of the housing to enhance the distribution of condensate over the heat exchanger. The housing is split about along the horizontal axis of the fan thereby furnishing ready access to the outdoor heat exchanger when the upper wall section is removed from the housing.

BRIEF DESCRIPTION OF THE DRAWINGS

For these and other objects of the present invention, reference will be made to the following detailed description of the invention which is to be read in association with the accompanying drawings wherein.

DETAILED DESCRIPTION OF THE INVENTION

Figure 1:
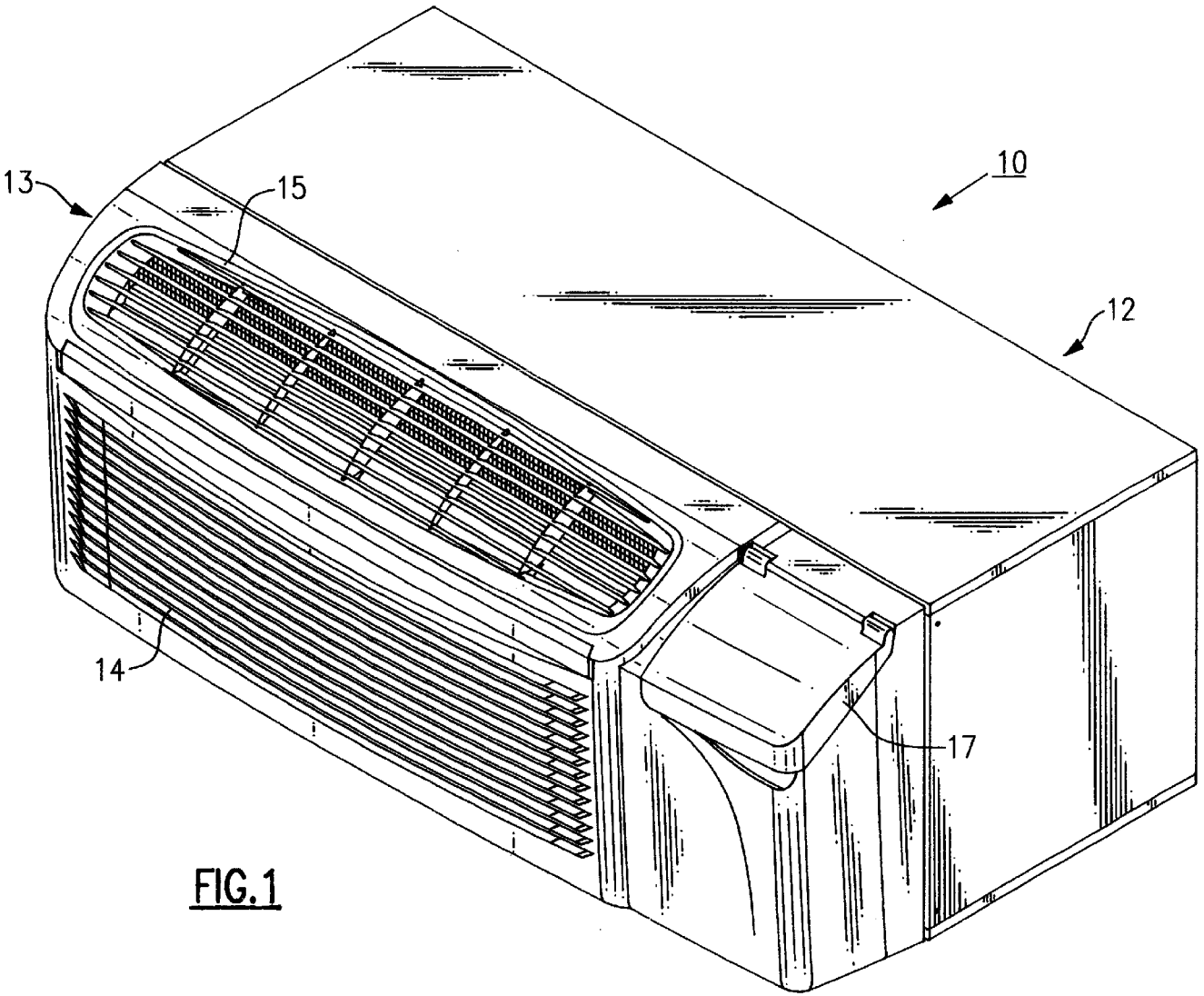
FIG. 1 is a front perspective view of an air conditioner embodying the teachings of the present invention.

Turning now to the drawings, there is illustrated a packaged terminal air conditioner (PTAC), generally referenced 10, that embodies the teachings of the present invention. The unit includes a rectangular shaped sleeve 12 which is normally mounted in an outside wall of a building that houses the room or comfort area being serviced by the air conditioning unit. The unit contains a front cover 13 that closes tightly against the sleeve. The cover further contains an inlet opening 14 through which air from the comfort region is drawn into the unit and an outlet opening 15 through which conditioned air is returned back into the comfort region. Internally, the unit is separated by a dividing wall 19 (FIG. 2) into an indoor section 18 that is located beneath the front cover of the unit and an outdoor section 20. Each section contains a heat exchanger and a fan for passing air over the heat exchanger surfaces. The controls for the unit are recessed behind the front cover and access to the controls is provided through a door 17 that is hinged to the cover.

Most PTAC units are provided with a cooling mode of operation and a heating mode of operation which can be selected by an occupant of the comfort region being serviced by the unit. As is well known in the art, the function of the heat exchangers will be reversed, depending upon the mode that is selected. The present invention will be described with specific reference to a unit that is operating in the cooling mode wherein the indoor heat exchanger is functioning as an evaporator and the outdoor heat exchanger is functioning as a condenser.

Figure 2:
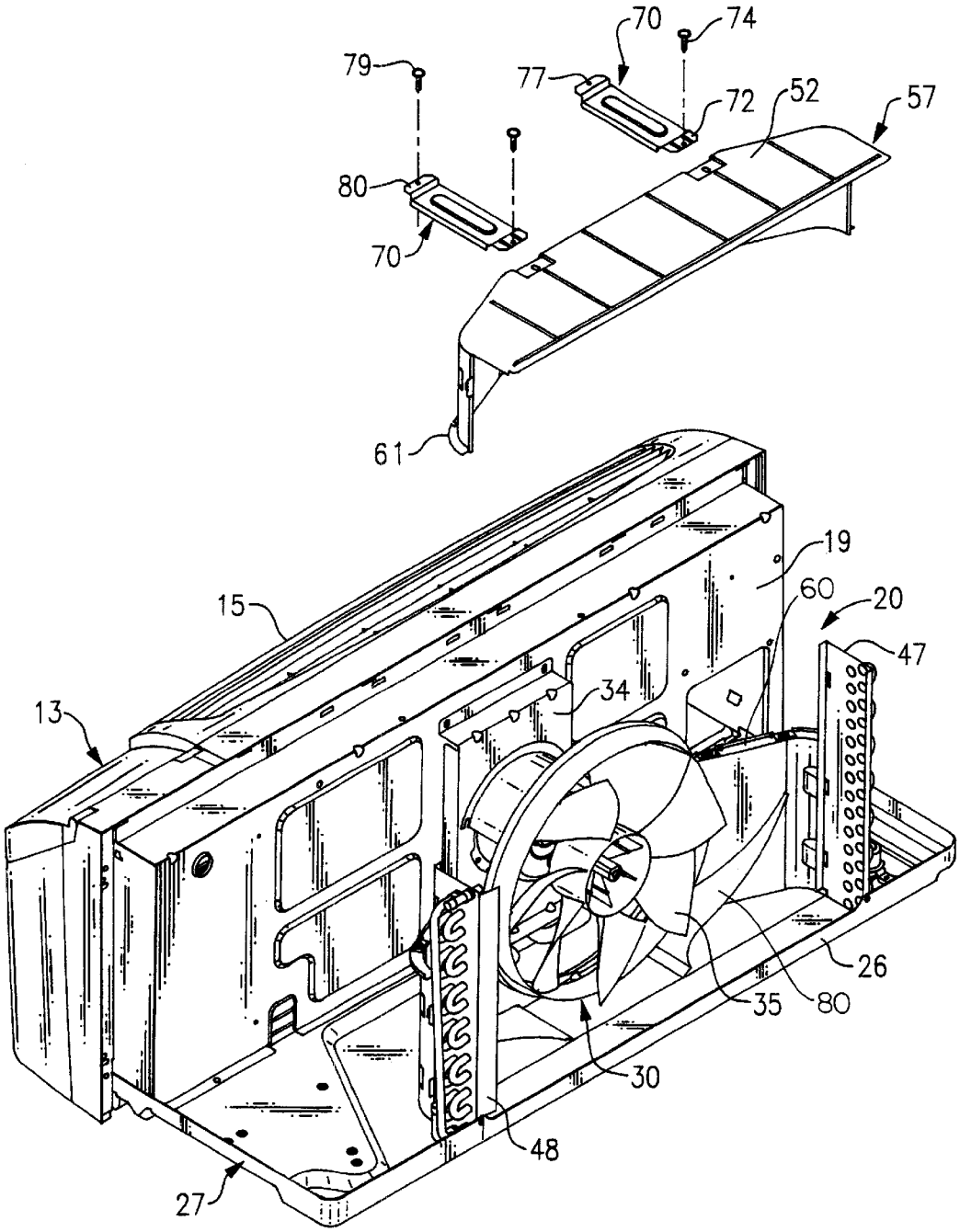
FIG. 2 is an exploded view in perspective of the air conditioner unit illustrated in FIG. 1 showing the unit removed from its sleeve and portions broken away to better illustrate the outdoor heat exchanger and fan.
Figure 3:
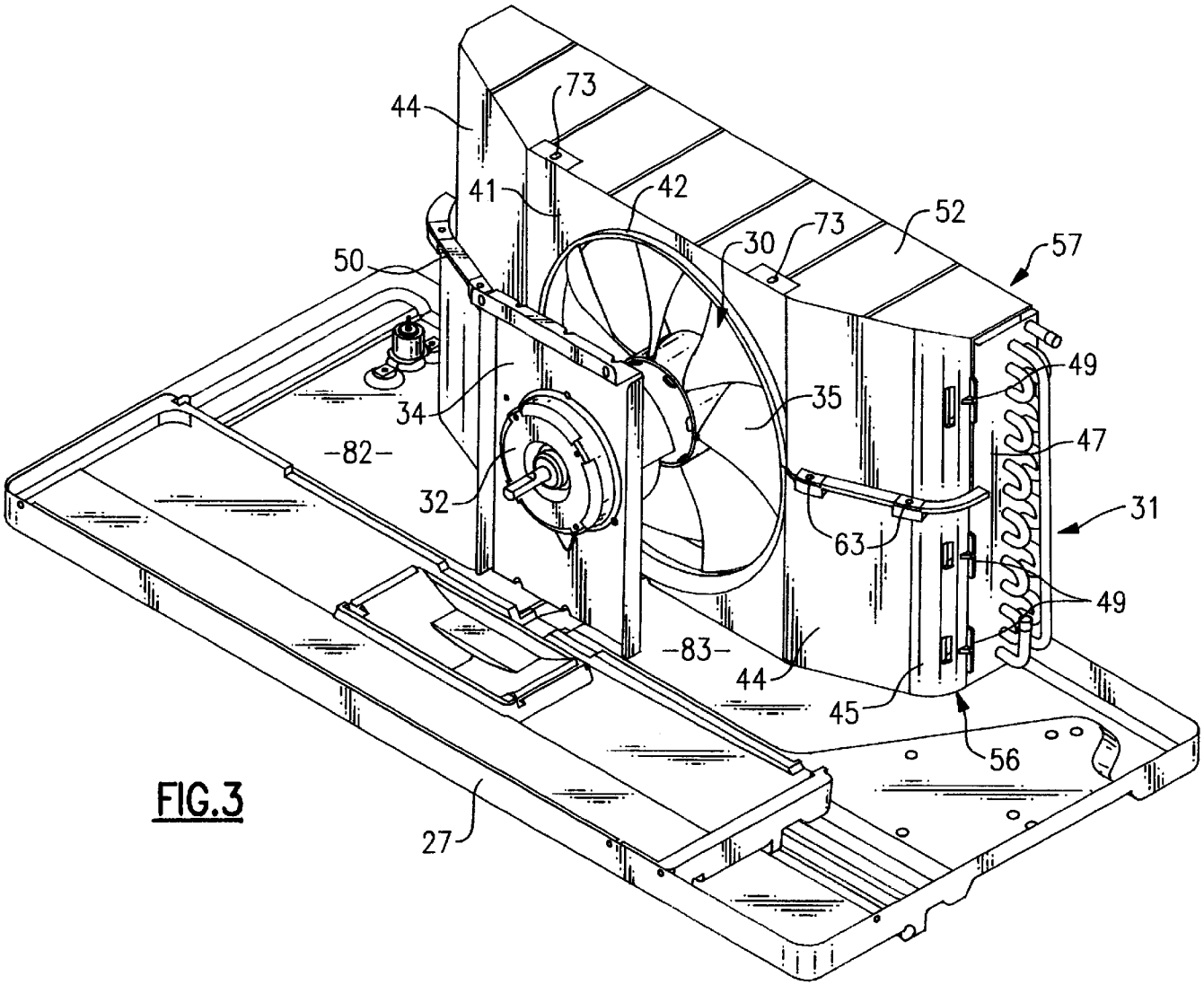
FIG. 3 is a front perspective view of the unit with parts broken away to show the front wall of said housing.

As best illustrated in FIGS. 2 and 3, the outdoor section 20 of the unit includes an outdoor heat exchanger 31 that is mounted along the back edge 26 of the base pan 27 of the unit. An outdoor fan 30 is mounted in front of the outdoor heat exchanger 25 and is driven by a motor 32 that is mounted in a motor support 34. The fan includes a series of blades 35 that are contained within a rotating shroud 37 and which are arranged to draw outside air through the back of the fan and distribute the air over the surfaces of the heat exchanger. As will be explained in further detail below, the fan and the shroud are also arranged to draw condensate that is collected in the base pan of the unit into the air stream and distribute tie condensate along with the air over the heat exchanger. A fan of this nature is described in further detail in the above noted U.S. Pat. No. 6,067,812, the details of which are herein incorporated by reference.

The outdoor fan 30 and the outdoor heat exchanger 31 are both mounted within a split housing, generally referenced 40, with the heat exchanger forming the back wall of the housing. The front wall 41 of the housing contains a circular opening 42 that surrounds the outdoor fan and through which outdoor air is drawing into the housing by the fan. A pair of co-joined side panels 44 and 45 extend outwardly from the opposing side edges of the front wall. The panels are canted toward the two ends of the heat exchanger with the outer panels 45 being joined to the two opposed tube sheets 47 and 48 of the heat exchanger. The outer panels are connected to the tube sheets by a series of clips 49 so that the heat exchanger can be easily disconnected from the housing when necessary, such as during periods when the unit requires servicing. The housing further includes a horizontally disposed top wall 52 that extends outwardly from the front wall of the housing over the top of the outdoor heat exchanger.

As noted above, the outdoor section of the unit is exposed to the elements and dirt and air borne contaminants can be drawn into the housing where they collect upon the heat exchanger surfaces. As a consequence, the efficiency of the unit is adversely effected and more energy must be consumed to maintain the comfort air at a desired level. Depending upon a number of factors, the outdoor heat exchanger must be periodically cleaned to maintain the unit's performance at a high level. This has heretofore been accomplished by sliding the base pan out of the sleeve and dismounting the entire housing so that sufficient access could be gained to all the heat exchanger surfaces.

The present outdoor heat exchanger housing 40 is split along a parting line 50 into two sections which are the lower section 56 and the upper section 57. In assembly, the lower section of the housing is secured in a stationary upright position to the base pan of the unit by screws or any other suitable fasteners as known and used in the art. The upper section of the housing, in turn, is seated upon the lower section. The top edge of the lower section and the lower edge of the upper section are provided with horizontally disposed rims 60 and 61, respectively, which come together in assembly and are secured in abutting contact by removable clips 63 or threaded fasteners so that the upper section can be quickly disassembled from the lower section. The parting lien 50 of the housing lies in a horizontal plane that is described by the horizontal axis 69 of the fan opening in the front wall of the housing so as to furnish a maximum amount of access to the outdoor heat exchanger when the upper section of the housing is removed.

A pair of brackets 70—70 are arranged to connect the top wall 52 of the upper housing section to the dividing unit 19 of the air conditioning unit. A tab 72 on one end of each bracket is received in a recess 73 formed in the top wall 52 of the housing and is secured therein by a screw 74. The opposite end of each bracket is further provided by a raised tab 77 that is arranged to be received with a slot 78 (FIG. 4) formed in the dividing wall 19. Screws 79 are passed through holes in the top of the wall and engage threaded holes 80 in the raised tabs to secure the brackets in the wall.

Figure 4:
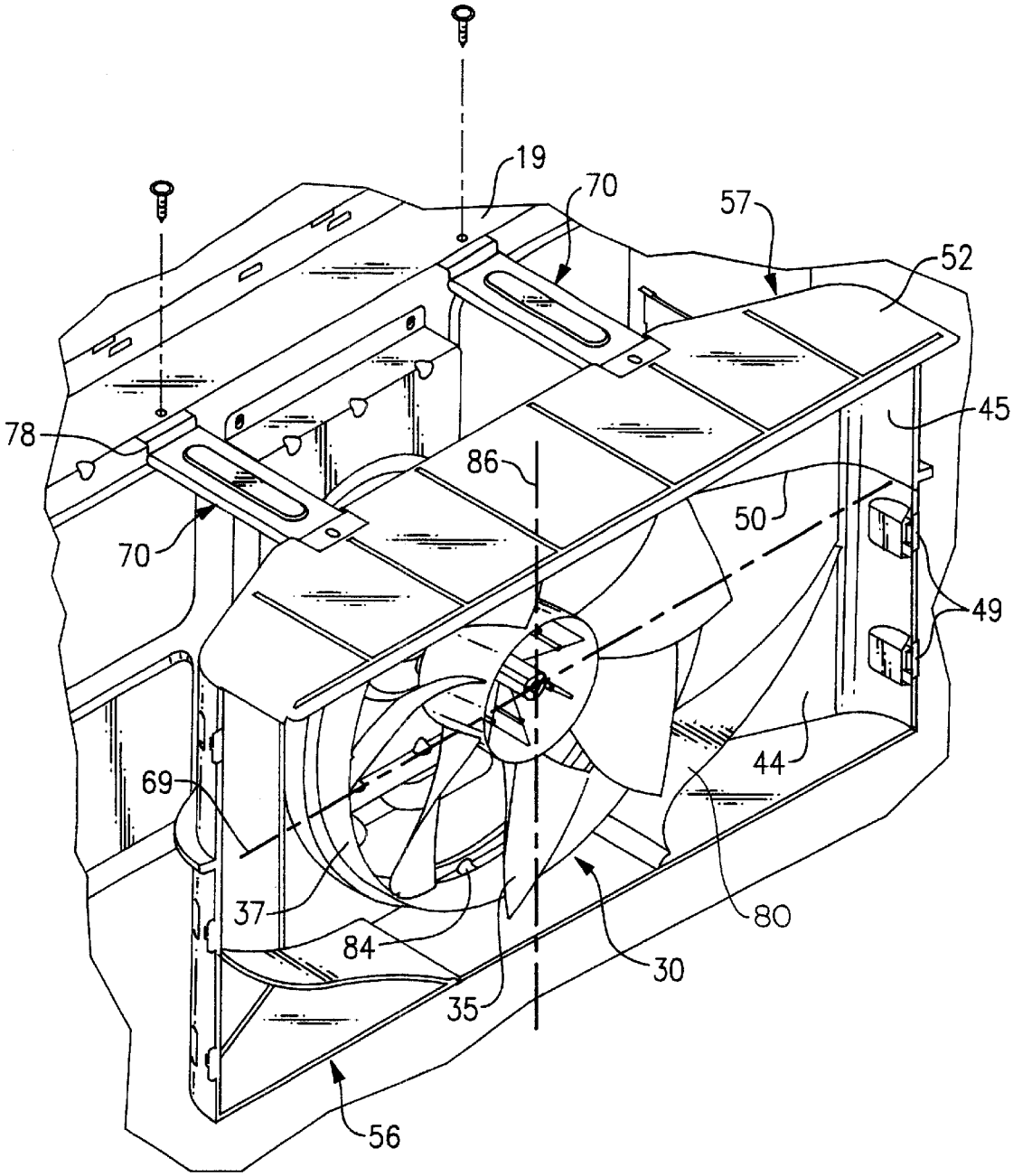
FIG. 4 is a partial perspective view of the outdoor heat exchanger housing with the outdoor heat exchanger removed and further illustrating the housing mounting brackets connected to the dividing wall of the air conditioning unit.

With further reference to FIG. 4, the inner surfaces of the outdoor heat exchanger housing are provided with stationary vanes 80—80 that are contoured to direct condensate leaving the fan across the heat exchanger surfaces. The base pan 27 of the unit is provided with inclined surfaces 82 and 83 that slant downwardly toward al orifice 84 (FIG. 4) provided in the bottom of the lower wall of the outdoor heat exchanger housing so that the condensate collected in the pan is brought to the orifice entrance. The orifice is positioned along the vertical axis 86 of the fan opening at an elevation such that the fan can effectively draw condensate through the orifice. As explained in the previously noted U.S Pat. No. 6,067,812, the pressure differential that is developed over the outdoor fan causes the condensate drawn through the orifice to move into the path of the slinger, which in turn, redirects the condensate toward the outdoor heat exchanger. The vanes 80—80 are designed to act in concert with the slinger to produce a uniform distribution of the condensate over the entire surface of the heat exchanger, thereby improving the efficiency of the outdoor heat exchanger and the overall performance of the unit when the unit is in a cooling mode of operation.

While this invention has been explained with reference to the structure disclosed herein, it is not confined to the details set forth and this invention is intended to cover any modifications and changes as may come within the scope of the following claims.

What is claimed is:

1. In an air conditioning unit having an indoor section and an outdoor section, each section containing a heat exchanger and a fan for distributing air over the heat exchanger and a dividing wall for separating the two sections, a housing contained entirely within the outdoor section for enclosing the outdoor heat exchanger that includes:

a stationary lower section and a removable upper section, said housing further including a front wall with an opening that surrounds said outdoor fan and includes side panels that are connected to opposing tube sheets of said outdoor heat exchanger, said lower section of the housing having a horizontally disposed lower flange extending about its top edge;

said upper section of the housing having a horizontally disposed upper flange extending about its bottom edge that is arranged to seat in contact with the lower flange; and fastener means for removably securing the upper flange to the lower flange.

2. The housing of claim 1 that further includes a pair of brackets for securing said upper wall section to the dividing wall of said unit.

3. The housing of claim 2 wherein one end of each bracket is connected to the top wall by threaded fasteners and the opposite end of each bracket is connected to the dividing wall by threaded fasteners.

4. The housing of claim 1 wherein the inside surface of said lower wall section contains a series of vanes for distributing moisture discharged by the outdoor fan across the heat exchanger surfaces.

5. The housing of claim 1 wherein the lower section of the housing contains a hole in the bottom part thereof that communicates with said fan to draw condensate into said housing.

6. The housing of claim 5 wherein said hole is aligned with a vertical axis of said opening formed in the back wall of the housing.

7. The housing of claim 1 wherein said top wall of the upper section of the housing passes over the top of the outdoor heat exchanger.

8. The housing of claim 1 wherein said housing sections are separated along a parting line that is aligned with the horizontal axis of the opening formed in the back wall of said housing.

* * * * *